US011208903B1

(12) United States Patent
Duong et al.

(10) Patent No.: US 11,208,903 B1
(45) Date of Patent: Dec. 28, 2021

(54) STIFFNESS COUPLING AND VIBRATION DAMPING FOR TURBINE BLADE SHROUD

(71) Applicant: Solar Turbines Incorporated, San Diego, CA (US)

(72) Inventors: Loc Quang Duong, San Diego, CA (US); Olivier J. Lamicq, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 16/953,633

(22) Filed: Nov. 20, 2020

(51) Int. Cl.
*F01D 5/22* (2006.01)
*F01D 11/00* (2006.01)
*F01D 11/02* (2006.01)

(52) U.S. Cl.
CPC ..... *F01D 5/225* (2013.01); *F01D 11/008* (2013.01); *F01D 11/025* (2013.01)

(58) Field of Classification Search
None
See application file for complete search history.

(56) References Cited

U.S. PATENT DOCUMENTS 3,258,245 A 6/1966 Alderson
3,752,599 A 8/1973 Pace
3,856,077 A * 12/1974 Siegla ..... F28D 19/047 165/9
3,881,844 A 5/1975 Hennessey et al.
5,431,543 A * 7/1995 Brown ..... F01D 5/26 29/889.21
5,987,879 A * 11/1999 Ono ..... F01D 9/023 60/800
6,139,264 A * 10/2000 Schilling ..... F01D 11/001 415/174.2
6,447,253 B2 * 9/2002 Tempere ..... F01D 5/323 416/221
6,588,214 B2 * 7/2003 Mack ..... F01D 9/023 60/798
6,854,738 B2 * 2/2005 Matsuda ..... F23R 3/60 277/632
7,784,264 B2 * 8/2010 Weaver ..... F01D 9/023 60/39.37
8,104,291 B2 * 1/2012 Myers ..... F23R 3/283 60/800
8,186,961 B2 * 5/2012 Stone ..... F01D 5/326 416/221
9,909,431 B2 * 3/2018 Polyzopoulos ..... F01D 5/323
10,301,948 B2 5/2019 Wilber
10,385,701 B2 8/2019 Kareff et al.
10,487,674 B2 * 11/2019 Rehnsch ..... F01D 5/323
10,690,059 B2 * 6/2020 Barton ..... F16J 15/16
(Continued)

*Primary Examiner* — Michael Lebentritt
(74) *Attorney, Agent, or Firm* — Procopio, Cory, Hargreaves & Savitch LLP

(57) ABSTRACT

During operation, a bladed rotor disk typically experiences out-of-plane vibration which can result in deterioration and/or cracking at the interface between adjacent shrouds of the turbine blades. In an embodiment, slots are formed at the end of a labyrinth seal segment of each shroud. Preloaded spring strips are inserted through the slots to couple adjacent shrouds while preventing the natural frequency of the turbine blades from drifting to the operating speed range and/or providing vibration damping to the untuned blade mode.

20 Claims, 7 Drawing Sheets

(56) References Cited

U.S. PATENT DOCUMENTS

| | | | | |
|---|---|---|---|---|
| 2016/0102721 | A1* | 4/2016 | Foucoin | F16D 55/225 188/71.8 |
| 2017/0067348 | A1* | 3/2017 | Kareff | F01D 5/22 |
| 2017/0306768 | A1 | 10/2017 | Szrajer et al. | |
| 2019/0301288 | A1 | 10/2019 | Umehara et al. | |

* cited by examiner

STIFFNESS COUPLING AND VIBRATION DAMPING FOR TURBINE BLADE SHROUD

TECHNICAL FIELD

The embodiments described herein are generally directed to blades in a gas turbine engine, and, more particularly, to stiffness coupling and vibration damping in turbine blades.

BACKGROUND

During operation, a bladed rotor disk typically experiences out-of-plane vibration, expressed in terms of nodal diameter. This out-of-plane vibration commonly results in relative anti-phase motion (i.e., separation) between the shrouds of adjacent blades. In turn, the relative anti-phase motion may result in damage to the adjacent shrouds, including fretting and deterioration at the abutment interface between the adjacent shrouds and cracking at the leading edge and labyrinth seal of each shroud. This anti-phase motion may also reduce the natural frequency of the blade.

U.S. Pat. No. 10,301,948 discloses a hollow airfoil that is filled with a filler, comprising a preloaded spring, to dampen vibratory response of the airfoil. However, such an airfoil requires a pocket to receive the filler, which increases manufacturing costs and complexity, and does not specifically address vibration from inter-blade interaction (i.e., nodal-diameter-type vibration).

The present disclosure is directed toward overcoming one or more of the problems discovered by the inventors.

SUMMARY

In an embodiment, a spring strip for vibration damping in a turbine blade is disclosed that comprises: a flat portion; a curved portion having a first end connected to the flat portion and a second end opposite the flat portion; and wherein the second end of the curved portion is malleable to bend into a tab in a direction away from the first end of the curved portion and at a preload distance from the flat portion.

In an embodiment, a turbine rotor assembly is disclosed that comprises: a turbine rotor disk; and a plurality of turbine blades arranged circumferentially around the turbine rotor disk and extending radially from the turbine rotor disk, wherein each of the plurality of turbine blades comprises an airfoil, and a shroud having a leading edge and a trailing edge opposite the leading edge, wherein the shroud comprises a substrate connected to a radially outward end of the airfoil, a first labyrinth seal segment extending from the substrate along the leading edge from a first end of the shroud to a second end of the shroud that is opposite the first end of the shroud, wherein the first labyrinth seal segment comprises a first slot at the first end of the shroud, and a second labyrinth seal segment extending from the substrate along the trailing edge from the first end of the shroud to the second end of the shroud and parallel to the first labyrinth seal segment, wherein the second labyrinth seal segment comprises a second slot at the second end of the shroud.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

For clarity and ease of explanation, some surfaces and details may be omitted in the present description and figures. In addition, references herein to "upstream" and "downstream" are relative to the flow direction of the primary gas (e.g., air) used in the combustion process, unless specified otherwise. It should be understood that "upstream" refers to a position that is closer to the source of the primary gas or a direction towards the source of the primary gas, and "downstream" refers to a position that is farther from the source of the primary gas or a direction that is away from the source of the primary gas. Thus, a trailing edge or end of a component (e.g., a vane) is downstream from a leading edge or end of the same component. Also, it should be understood that, as used herein, the terms "side," "top," "bottom," "front," and "rear" are used for convenience of understanding to convey the relative positions of various components with respect to each other, and do not imply any specific orientation of those components in absolute terms (e.g., with respect to the external environment or the ground).

Figure 1:
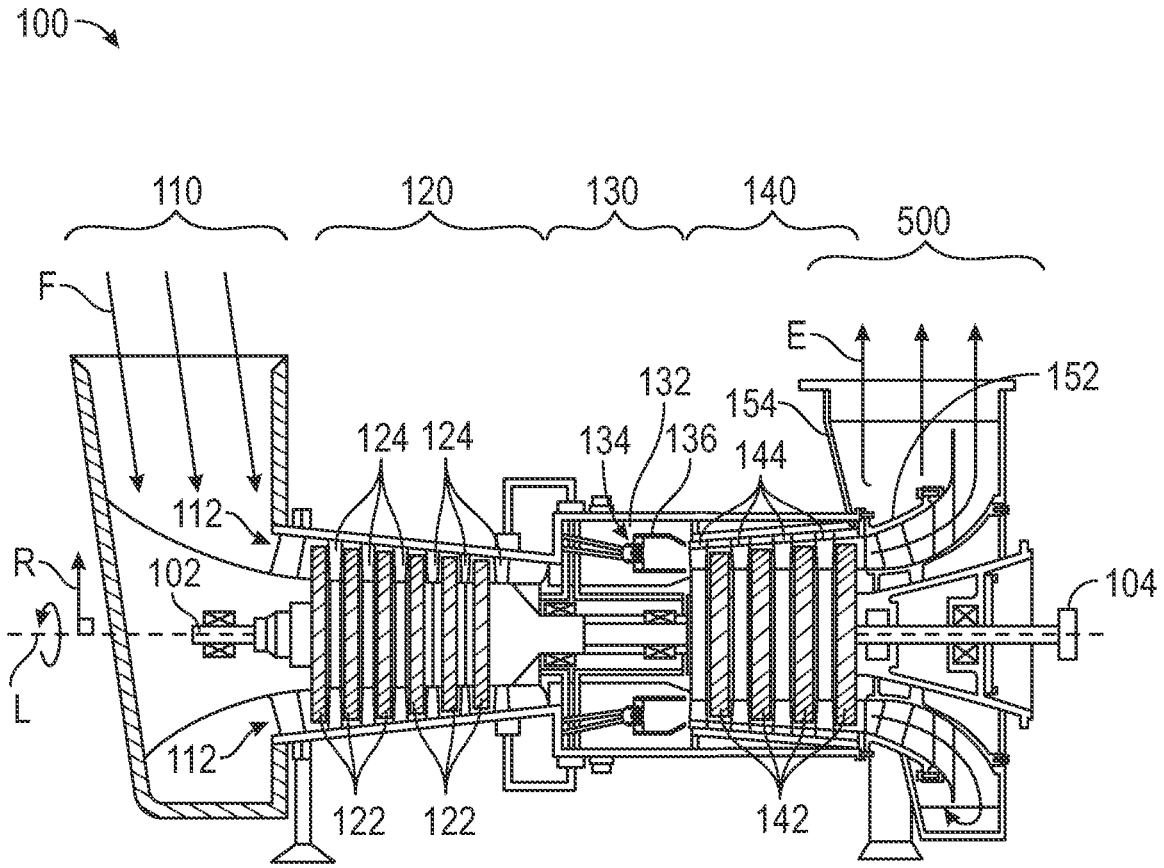
FIG. 1 illustrates a schematic diagram of a gas turbine engine, according to an embodiment.

FIG. 1 illustrates a schematic diagram of a gas turbine engine 100, according to an embodiment. Gas turbine engine 100 comprises a shaft 102 with a central longitudinal axis L. A number of other components of gas turbine engine 100 are concentric with longitudinal axis L and may be annular to longitudinal axis L. All references herein to radial, axial, and circumferential directions are relative to longitudinal axis L. A radial axis may refer to any axis or direction that radiates outward from longitudinal axis L at a substantially orthogonal angle to longitudinal axis L, such as radial axis R in FIG. 1. As used herein, the term "axial" will refer to any axis or direction that is substantially parallel to longitudinal axis L.

In an embodiment, gas turbine engine 100 comprises, from an upstream end to a downstream end, an inlet 110, a compressor 120, a combustor 130, a turbine 140, and an exhaust outlet 150. In addition, the downstream end of gas turbine engine 100 may comprise a power output coupling 104. One or more, including potentially all, of these components of gas turbine engine 100 may be made from stainless steel and/or durable, high-temperature materials known as "superalloys." A superalloy is an alloy that exhibits excellent mechanical strength and creep resistance at high temperatures, good surface stability, and corrosion and oxidation resistance. Examples of superalloys include, without limitation, Hastelloy, Inconel, Waspaloy, Rene alloys, Haynes alloys, Incoloy, MP98T, TMS alloys, and CMSX single crystal alloys.

Inlet 110 may funnel a working fluid F (e.g., the primary gas, such as air) into an annular flow path 112 around longitudinal axis L. Working fluid F flows through inlet 110 into compressor 120. While working fluid F is illustrated as flowing into inlet 110 from a particular direction and at an angle that is substantially orthogonal to longitudinal axis L, it should be understood that inlet 110 may be configured to receive working fluid F from any direction and at any angle that is appropriate for the particular application of gas turbine engine 100. While working fluid F will primarily be described herein as air, it should be understood that working fluid F could comprise other fluids, including other gases.

Compressor 120 may comprise a series of compressor rotor assemblies 122 and stator assemblies 124. Each compressor rotor assembly 122 may comprise a rotor disk that is circumferentially populated with a plurality of rotor blades. The rotor blades in a rotor disk are separated, along the axial axis, from the rotor blades in an adjacent disk by a stator assembly 124. Compressor 120 compresses working fluid F through a series of stages corresponding to each compressor rotor assembly 122. The compressed working fluid F then flows from compressor 120 into combustor 130.

Combustor 130 may comprise a combustor case 132 housing one or more, and generally a plurality of, fuel injectors 134. In an embodiment with a plurality of fuel injectors 134, fuel injectors 134 may be arranged circumferentially around longitudinal axis L within combustor case 132 at equidistant intervals. Combustor case 132 diffuses working fluid F, and fuel injector(s) 134 inject fuel into working fluid F. This injected fuel is ignited to produce a combustion reaction in one or more combustion chambers 136. The combusting fuel-gas mixture drives turbine 140.

Turbine 140 may comprise one or more turbine rotor assemblies 142 and stator assemblies 144. Each turbine rotor assembly 142 may correspond to one of a plurality or series of stages. Turbine 140 extracts energy from the combusting fuel-gas mixture as it passes through each stage. The energy extracted by turbine 140 may be transferred (e.g., to an external system) via power output coupling 104.

The exhaust E from turbine 140 may flow into exhaust outlet 150. Exhaust outlet 150 may comprise an exhaust diffuser 152, which diffuses exhaust E, and an exhaust collector 154 which collects, redirects, and outputs exhaust E. It should be understood that exhaust E, output by exhaust collector 154, may be further processed, for example, to reduce harmful emissions, recover heat, and/or the like. In addition, while exhaust E is illustrated as flowing out of exhaust outlet 150 in a specific direction and at an angle that is substantially orthogonal to longitudinal axis L, it should be understood that exhaust outlet 150 may be configured to output exhaust E towards any direction and at any angle that is appropriate for the particular application of gas turbine engine 100.

Figure 2:
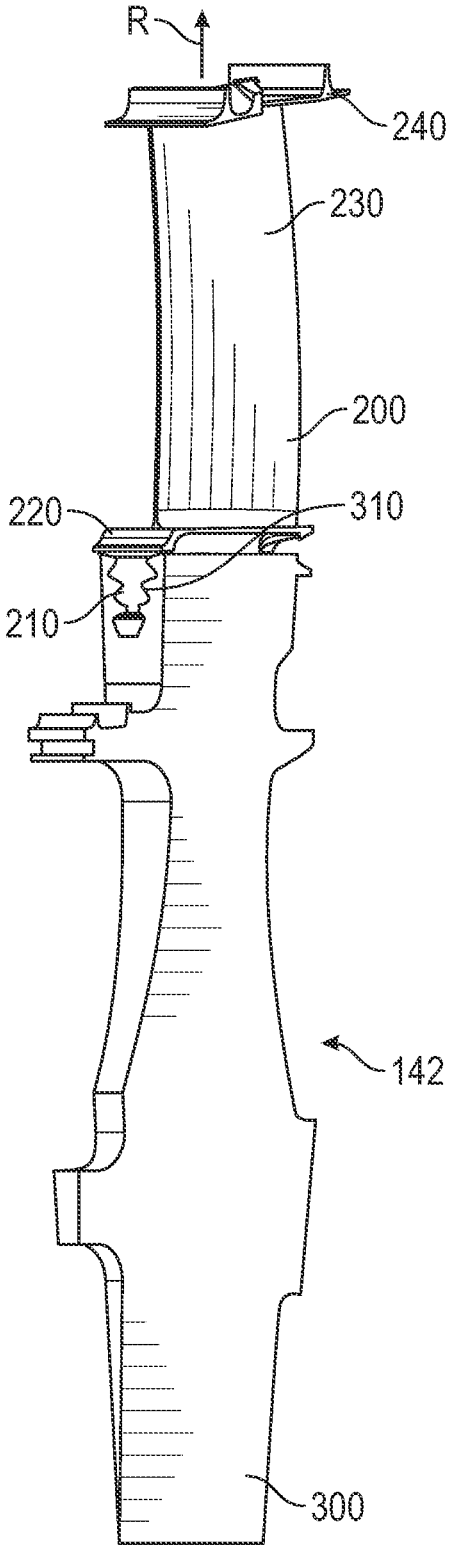
FIG. 2 illustrates a cross-sectional slice of a turbine rotor assembly, according to an embodiment.

FIG. 2 illustrates a cross-sectional slice of a turbine rotor assembly 142, according to an embodiment. FIG. 2 only illustrates a single turbine blade 200 and a single slice of the turbine rotor disk 300 supporting the single turbine blade 200. It should be understood that, in reality, a turbine rotor assembly 142 would comprise a plurality of such slices rotated continuously around longitudinal axis L in turbine 140, with a plurality of turbine blades 200 extending radially outward around longitudinal axis L. Each slice, including each of the plurality of turbine blades 200, may be identical to each other. However, in alternative embodiment, one or more of the slices or turbine blades may be different than one or more other slices or turbine blades.

In an embodiment, turbine blade 200 may comprise, from an inward to outward position along a radial axis R, a root 210, a platform 220, an airfoil 230, and a shroud 240. Root 210 may be configured to mate with a corresponding groove 310 in the circumference of turbine rotor disk 300. Root 210 may comprise a "fir tree," "bulb," or "dovetail" shape, and groove 310 may be reciprocally shaped to tightly receive root 210, such that root 210 fills groove 310. Thus, root 210 of each turbine blade 200 may be slid (e.g., downstream or upstream) into a respective groove 310 in turbine rotor disk 300 to be tightly held therein. This engagement between root 210 and groove 310 retains turbine blade 200 within turbine rotor disk 300, and prevents turbine blade 200 from moving in the radial and lateral directions relative to turbine rotor disk 300.

Root 210 is connected to a radially inward surface of platform 220, and airfoil 230 extends radially outward from the opposite, radially outward surface of platform 220. Airfoil 230 may have a complex geometry that varies along radial axis R. For example, the cross-section of airfoil 230 may lengthen, thicken, twist, and/or otherwise change shape along the radial axis R between platform 220 and shroud 240. It should be understood that the overall shape of airfoil 230 may vary depending on the particular application for which it is used.

Figure 3:
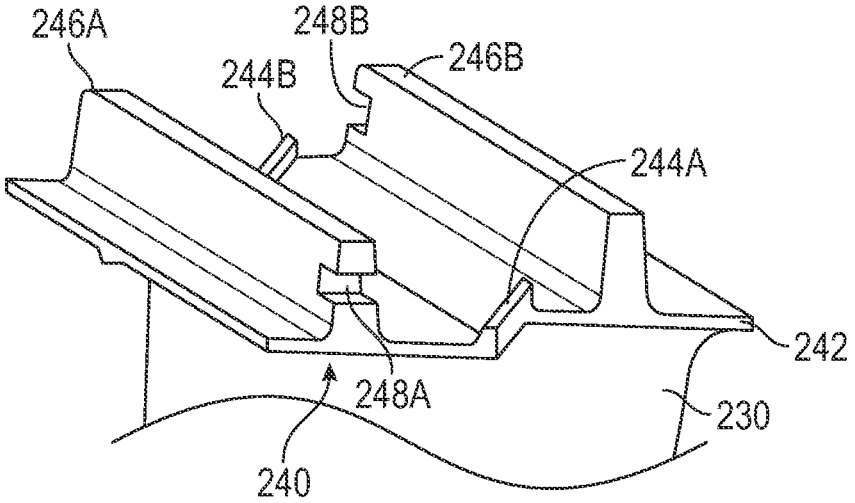
FIG. 3 illustrates a top perspective view of a shroud of a turbine blade, according to an embodiment.

FIG. 3 illustrates a top perspective view of shroud 240 of turbine blade 200, according to an embodiment. Shroud 240 may comprise a substrate 242, abutments 244A and 244B extending radially outward from opposite sides of substrate 242, and labyrinth seal segments 246A and 246B extending radially outward from opposite sides of substrate 242 and substantially parallel to each other. Shrouds 240 for a plurality of turbine blades 200, when arranged circumferentially around turbine rotor disk 300, are configured to abut with each other at the sides with abutments 244. As illustrated, these abutting sides may be configured with corresponding non-straight edges that form a tight fit with each other. Notably, labyrinth seal segments 246 of adjacent shrouds 240 will also abut at these edges.

In addition, each labyrinth seal segment 246 may comprise a recess or slot 248 through an edge of the labyrinth seal segment 246. For labyrinth seal segments 246A and 246B on the same shroud 240, slots 248 through those labyrinth seal segments 246 may be positioned on opposite diagonal corners of shroud 240. For example, as illustrated, slot 248A is positioned through a first end of upstream labyrinth seal segment 246A, whereas slot 248B is positioned through a second end, opposite the first end, of downstream labyrinth seal segment 246B. It should be understood that, in an alternative embodiment, the positions could be reversed. In an embodiment, each slot 248 is a rectangular parallelepiped (which includes, potentially, a cube) with three sides defined by three connected surfaces of its respective labyrinth seal segment 246 and with the remaining three remaining sides open.

Figure 4:
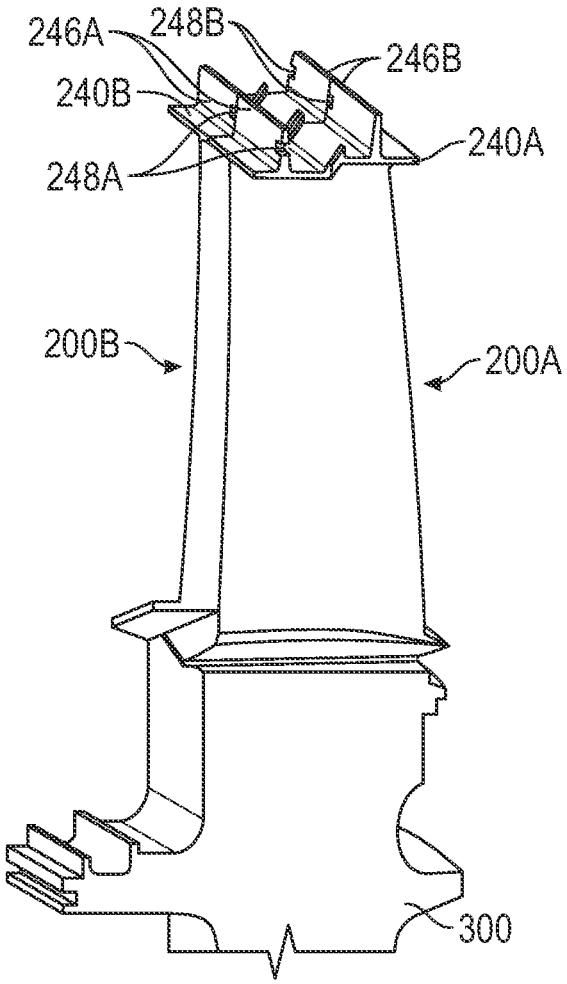
FIG. 4 illustrates a top perspective view of two adjacent turbine blades, according to an embodiment.

FIG. 4 illustrates a top perspective view of two adjacent turbine blades 200A and 200B, according to an embodiment. As illustrated, abutment 244B of a first shroud 240A on a first turbine blade 200A abuts abutment 244A of a second, adjacent shroud 240B on a second turbine blade 200B. Although not shown, it should be understood that abutment 244A of first shroud 240A on first turbine blade 200A would abut abutment 244B of a third shroud 240 on a third turbine blade 200 that is on an opposite side of first turbine blade 200A as second turbine blade 200B. A plurality of turbine blades 200 would be arranged circumferentially around turbine rotor disk 300, in this manner, with each turbine blade 200 positioned between two adjacent turbine blades 200 and each shroud 240 sandwiched between and abutting two adjacent shrouds 240. Collectively, shrouds 240 form a contiguous annular shroud encircling turbine rotor disk 300 with airfoils 230 therebetween. Notably, when assembled in this manner, labyrinth seal segments 246A will also abut to form a first contiguous labyrinth seal around the entire annular shroud on an upstream side of the complete assembly, and labyrinth seal segments 246B will also abut to form a second contiguous labyrinth seal around the entire annular shroud on a downstream side of the complete assembly.

In addition, when assembled in this manner, each slot 248 becomes enclosed on four sides. In particular, each slot 248 becomes a rectangular parallelepiped with three sides defined by three connected surfaces of its respective labyrinth seal segment 246 and one side defined by an abutting end surface of the adjacent labyrinth seal segment 246. The remaining two sides remain open and opposite to each other to form an aperture through the labyrinth seal.

Figure 5:
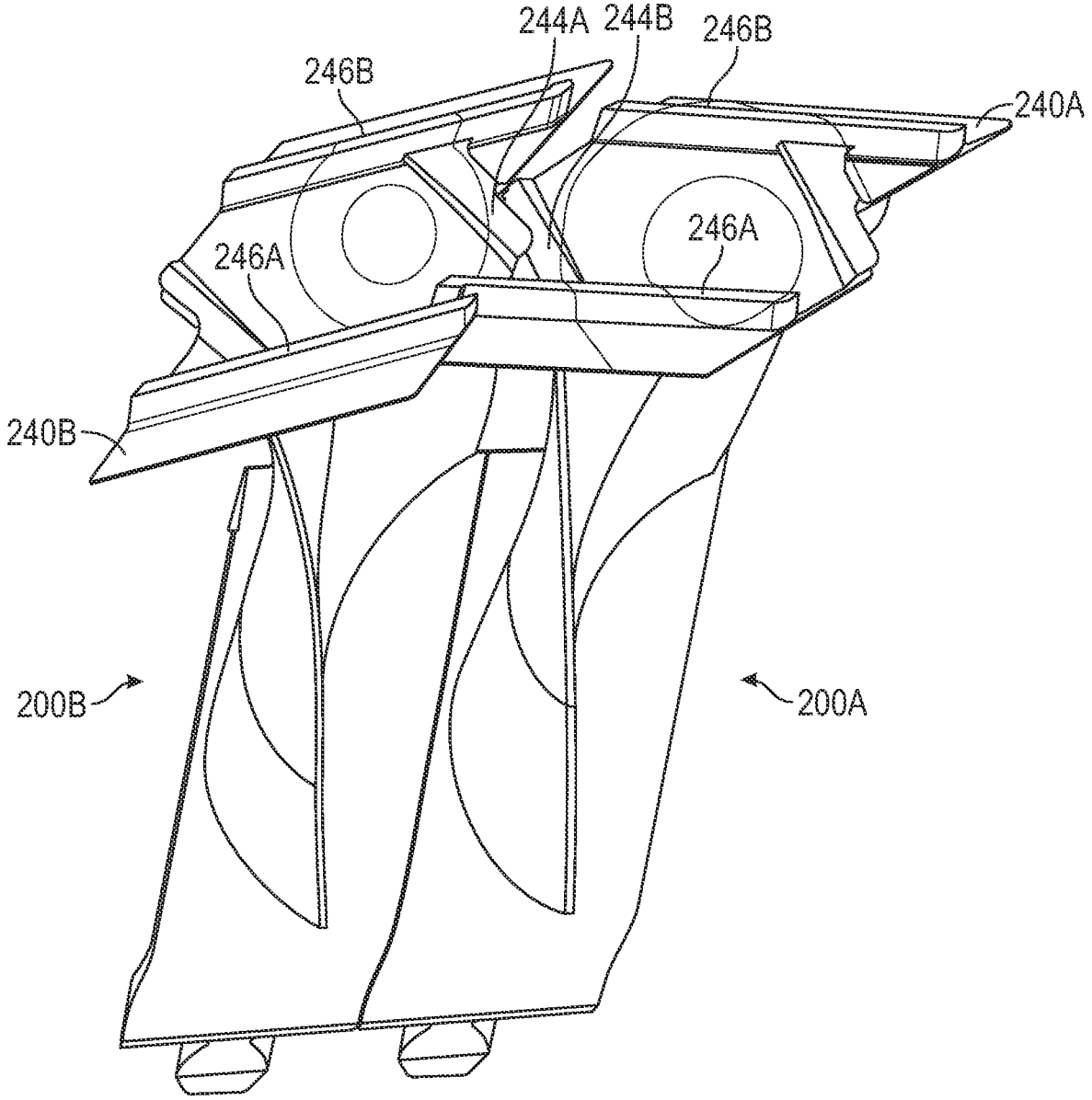
FIG. 5 illustrates a top perspective view of two adjacent turbine blades exhibiting out-of-plane vibration, according to an embodiment.

FIG. 5 illustrates a top perspective view of two adjacent turbine blades 200 exhibiting the out-of-plane vibration that can occur between abutting shrouds 240 of adjacent turbine blades 200, during operation of gas turbine engine 100, according to an embodiment. Typically, these vibrations can cause fretting and deterioration at the interface between abutments 244 of adjacent shrouds 240 and/or cracking at the upstream or leading-edge labyrinth seal segment 246A of each shroud 240. Thus, disclosed embodiments may provide damping to reduce the amplitude of these vibrations to an acceptable low cycle fatigue (LCF), high cycle fatigue (HCF) level, especially for untuned modes. In addition, disclosed embodiments may prevent pre-tuned frequencies from drifting down to the operating-speed range as a result of the softening of inter-blade stiffness coupling, which can expose the blades to a resonance condition.

Figure 6:
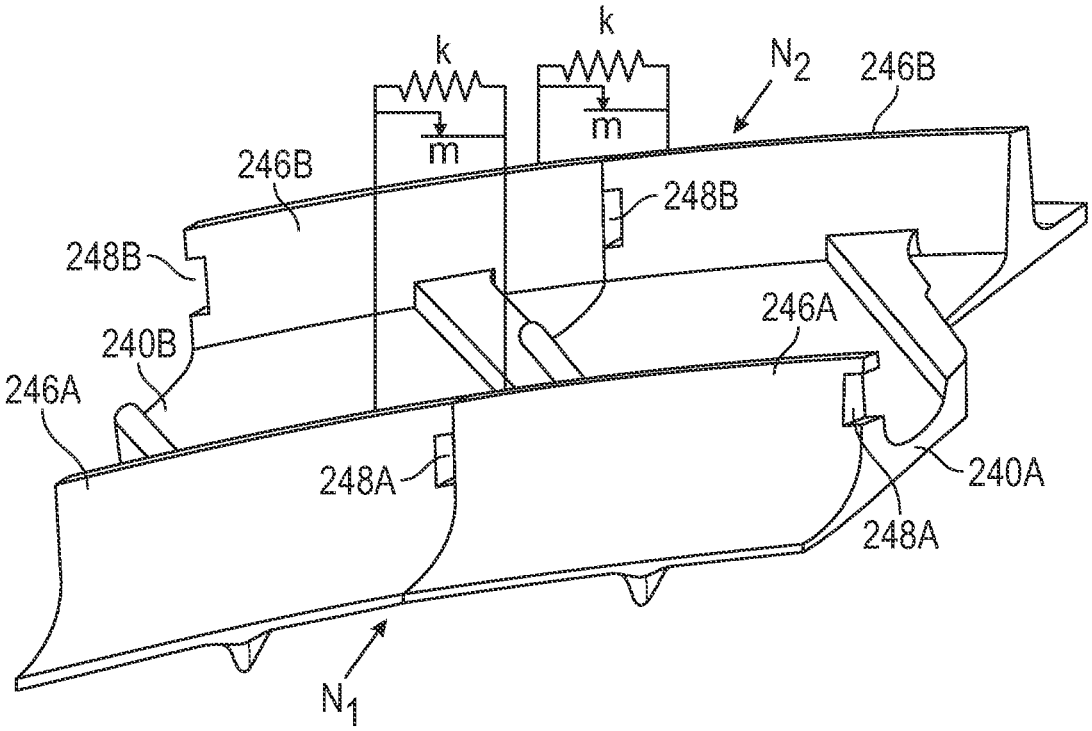
FIG. 6 illustrates a front perspective view of the shrouds of two adjacent turbine blades, according to an embodiment.

FIG. 6 illustrates a front perspective view of shrouds 240 of two adjacent turbine blades 200, according to an embodiment. As illustrated, each labyrinth seal segment 246 may comprise a slot 248 through an edge of the labyrinth seal segment 246. When turbine blades 200 are assembled, such that shrouds 240 form a contiguous annular shroud, slots 248A will be arranged at fixed intervals through the upstream labyrinth seal formed by labyrinth seal segments 246A, and slots 248B will be arranged at fixed intervals through the downstream labyrinth seal formed by labyrinth seal segments 246B. The fixed interval of slots 248A is equal to the fixed interval of slots 248B. However, slots 248A and 248B will be slightly shifted with respect to each other, since slots 248A and 248B are positioned through different ends of labyrinth seal segments 246. In this assembly, each slot 248 is a rectangular parallelepiped that is enclosed on three sides by surfaces of its respective labyrinth seal segment 246 and on a fourth side by an abutting end surface of the adjacent labyrinth seal segment 246. Two opposing sides remain open on the upstream and downstream sides of slot 248 to form an aperture through the labyrinth seal formed by the adjacent labyrinth seal segments 246. It should be understood that each of these apertures will provide a passage through the labyrinth seal along an axis that is parallel to longitudinal axis L. In an embodiment, each slot 248 is configured to hold a spring strip that is inserted through this passage.

Figure 7:
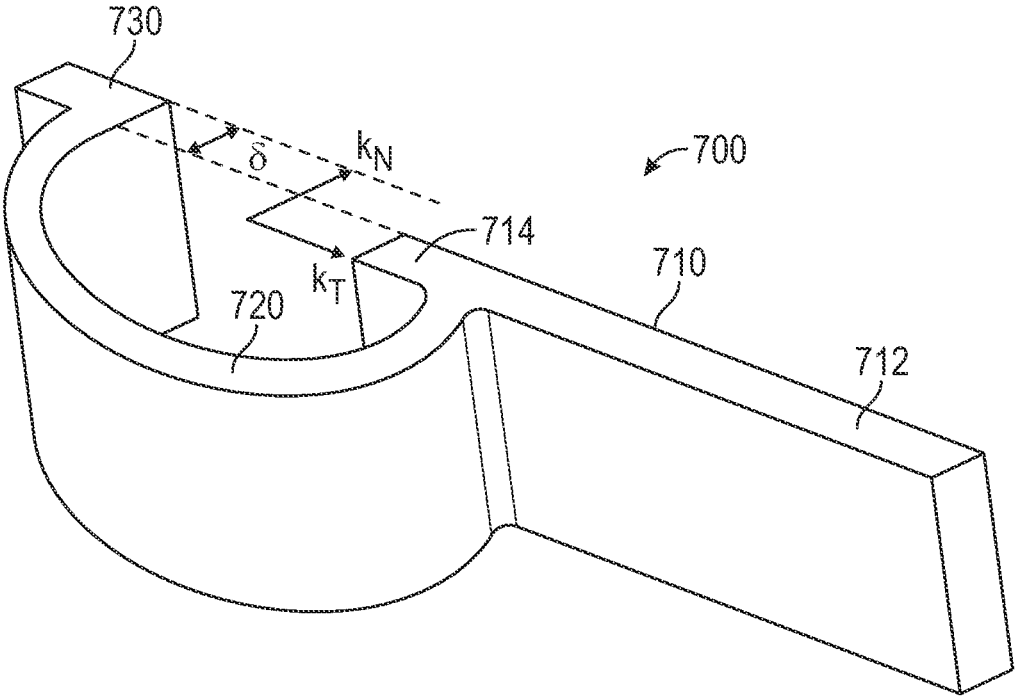
FIG. 7 illustrates a preloaded spring strip, according to an embodiment.

FIG. 7 illustrates a preloaded spring strip 700, according to an embodiment. A spring strip 700 may be inserted and preloaded through each slot 248. Each spring strip 700 may be made from a suitable metal (e.g., Stainless Steel 300 or 400 series) or other material with appropriate characteristics (e.g., malleability). Preferably, the material of spring strip 700 would be softer than the material from which labyrinth seal segment 246 is manufactured so that spring strip 700 does not erode labyrinth seal segment at the contact interfaces, and would be inexpensive so that spring strips 700 may be inexpensively replaced if deteriorated by the friction at its contact interfaces. In the illustrated embodiment, each preloaded spring strip 700 comprises a flat portion 710, a curved portion 720, and a tab 730. Flat portion 710 may comprise a first portion 712 and a second portion 714 on opposite sides and extending in opposite directions of the juncture between flat portion 710 and curved portion 720. However, in an alternative embodiment, second portion 714 may be omitted, such that flat portion 710 only consists of first portion 712. Tab 730 is on the opposite end of curved portion 720 than flat portion 710, and may be in a parallel plane to flat portion 710. The planes in which flat portion 710 and tab 730 lie may be separated by a preload length S.

Figure 8:
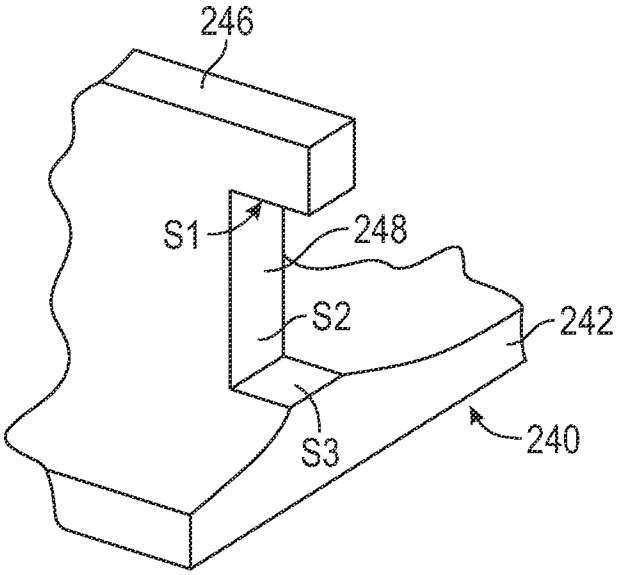
FIG. 8 illustrates a close-up perspective view of a slot, according to an embodiment.

FIG. 8 illustrates a close-up perspective view of a slot 248, according to an embodiment. As illustrated, slot 248 is shaped as a rectangular parallelepiped defined by three connected surfaces S1, S2, and S3. Surfaces S1 and S3 face each other on opposite sides of slot 248 and are both orthogonal to surface S2. When shroud 240 is assembled with an adjacent shroud 240, the edge of the labyrinth seal segment 246 of that adjacent shroud 240 will form a fourth surface that faces surface S2 on an opposite side of slot 248 and is orthogonal to surfaces S1 and S3, such that slot 248 becomes a rectangular aperture through the labyrinth seal.

Figure 9:
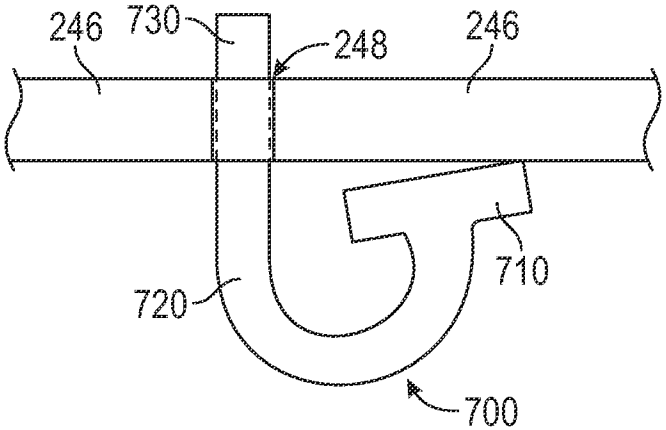
FIGS. 9-11 illustrate the insertion and preloading of a spring strip through a slot, according to an embodiment.
Figure 10:
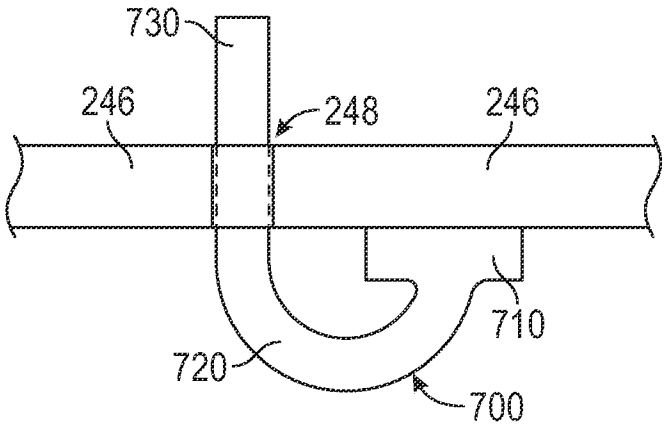
Figure 11:
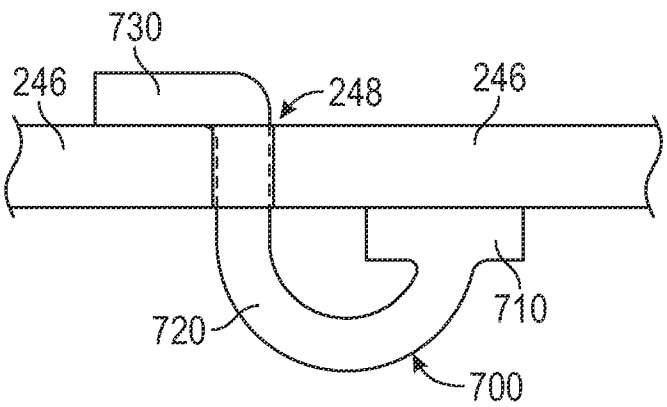

FIGS. 9-11 illustrate the insertion and preloading of spring strip 700 through a slot 248, according to an embodiment. Initially, as illustrated in FIG. 9, curved portion 720 of spring strip 700 is inserted through slot 248 in a labyrinth seal segment 246, and flat portion 710 contacts an upstream or downstream surface of the adjacent labyrinth seal segment 246. At this point, tab 730 has not yet been formed in spring strip 700. In an embodiment, each spring strip 700 is inserted in a direction from outside the labyrinth seal to inside the labyrinth seal (i.e., toward an interior of shroud 240). However, in an alternative embodiment, each spring strip 700 could be inserted in the opposite direction, from inside the labyrinth deal to outside the labyrinth seal (i.e., toward an exterior of shroud 240).

As illustrated in FIG. 10, a spring force is applied to fully insert curved portion 720, along with inchoate tab 730, through slot 248, such that flat portion 710 forms a full contact interface with the adjacent labyrinth seal segment 246. At this point, curved portion 720 is formed to its final curvature. Then, as illustrated in FIG. 11, tab 730 is made from appropriately malleable material so that it may be bent with respect to curved portion 720 and away from flat portion 710, such that tab 730 forms a full contact interface with labyrinth seal segment 246 at a preload length 6 from the plane of the contact interface between flat portion 710 and the adjacent labyrinth seal segment 246. It should be understood that the preload length 6 may be substantially the same as the width of labyrinth seal segments 246. In addition, tab 730 should be longer than the width of slot 248 to prevent spring strip 700 from falling out of slot 248.

Notably, flat portion 710 and tab 730, joined by curved portion 720, contact opposite surfaces of the labyrinth seal formed by adjacent labyrinth seal segments 246 of adjacent shrouds 240. For example, in an embodiment in which spring strip 700 is inserted from the outside, flat portion 710 contacts an outer surface of the labyrinth seal, whereas tab 730 contacts an inner surface of the labyrinth seal. Conversely, in an alternative embodiment in which spring strip 700 is inserted from the inside, flat portion 710 contacts an inner surface of the labyrinth seal, whereas tab 730 contacts an outer surface of the labyrinth seal. In either case, a pre-loaded damper force is applied to the contact interface between flat portion 710 and labyrinth seal segment 246.

Figure 12:
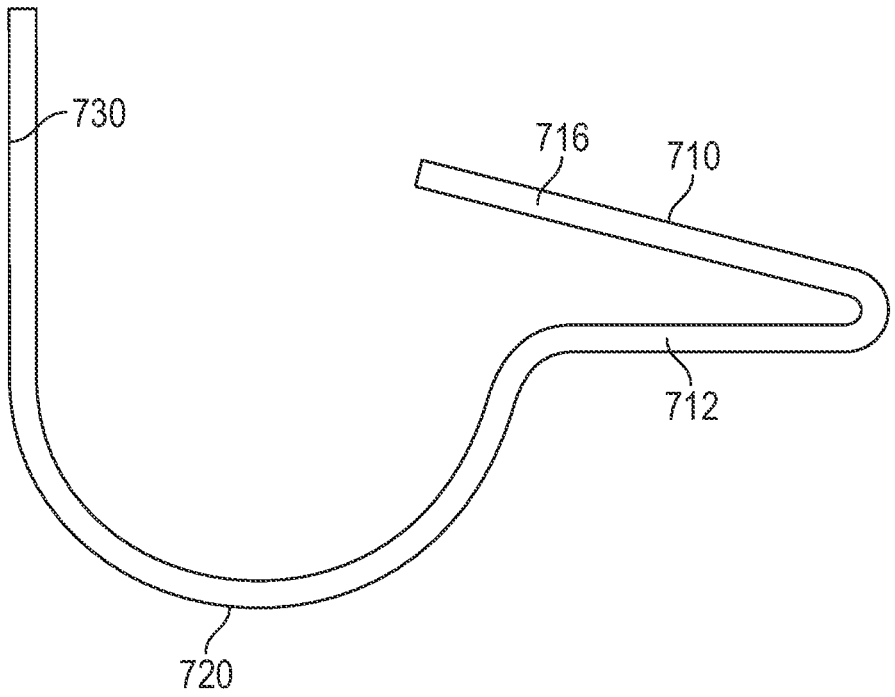
FIGS. 12 and 13 illustrate a spring strip, according to an alternative embodiment.
Figure 13:
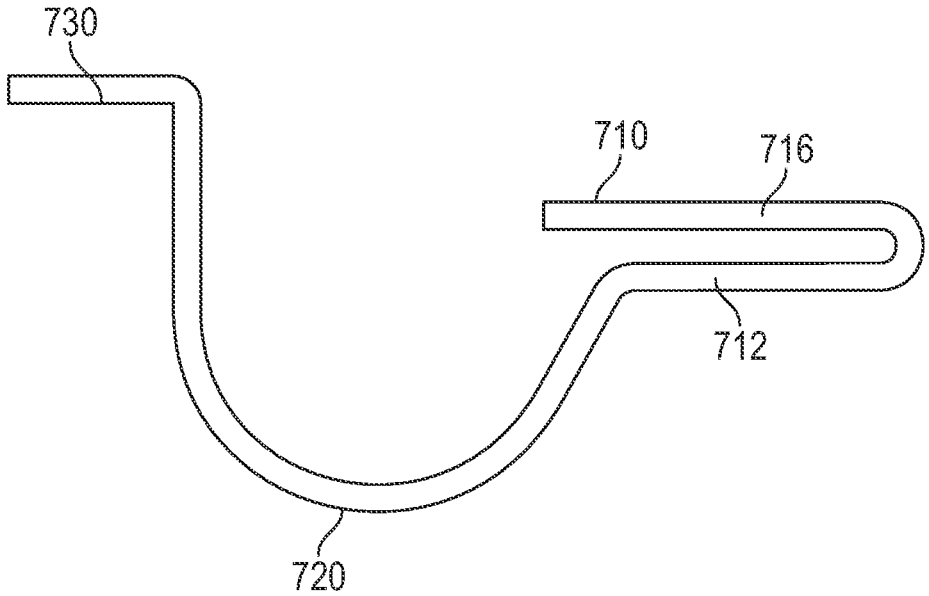

FIGS. 12 and 13 illustrate a spring strip 700, according to an alternative embodiment. In particular, FIG. 12 illustrates the profile of this alternative embodiment of spring strip 700 prior to assembly, and FIG. 13 illustrates the profile of this alternative embodiment of spring strip 700 after insertion and preloading. The difference between this alternative embodiment and the embodiment illustrated in FIG. 7 is in the configuration of flat portion 710. Specifically, in this alternative embodiment, flat portion 710 may be bent back on itself to create a clip with a first portion 712 and a second portion 716. As illustrated in FIG. 13, when inserted into a slot 248, second portion 716 is compressed towards first portion 712 by one side of a labyrinth seal segment 246 that is adjacent to the labyrinth seal segment 246 in which the slot 248 is formed, to create a contact interface between second portion 716 and that adjacent labyrinth seal segment 246. In addition, tab is bent to a substantially orthogonal angle with respect to the end of curved portion 720 and away from flat portion 710, to create a contact interface between tab 730 and a side, opposite the side with which second portion 716 is interfaced, of the labyrinth seal segment 246 having the slot 248. In summary, this embodiment has two spring forces in series.

INDUSTRIAL APPLICABILITY

When spring strip 700 is inserted and preloaded through a slot 248, it couples adjacent shrouds 240 together at adjacent labyrinth seal segments 246. Each spring strip 700 imparts a stiffness k (illustrated in FIG. 6), which is composed of a normal stiffness $k_N$ and a tangential stiffness $k_T$ (illustrated in FIG. 7), to the shroud when subject to a resonance condition, and a contact interface with a coefficient of friction μ (illustrated in FIG. 6). Each pair of spring strips 700 in slots 248A and 248B on opposite sides of the labyrinth seal are arranged in reverse, such that the preload normal forces $N_1$ and $N_2$ (illustrated in FIG. 6) are opposite of each other. However, in an alternative embodiment, spring strips 700 may be provided in slots 248 in only a single labyrinth seal (e.g., the upstream labyrinth seal or the downstream labyrinth seal), instead of in both labyrinth seals (i.e., both the upstream and downstream labyrinth seals).

Under the resonance condition, the pairs of spring strips 700 reduce oscillation in the tangential direction of turbine blades 200 via Coulomb friction F at the contact interfaces:

$$F=\mu N$$

$$N=k_N\delta$$

wherein μ is the coefficient of friction of the contact interface, N is the preload force normal to the face of labyrinth seal segments 246, $k_N$ is the normal stiffness of spring strip 700, and δ (illustrated in FIG. 7) is the preload length of spring strip 700.

The frictional dissipation energy E is a function of $k_N$ and δ:

$$E=FS=\mu(k_N\delta)S$$

wherein S is sliding distance. The under-damp amplitude may primarily be controlled by the combination of the stiffness k in pairs of spring strips 700. Advantageously, embodiments of spring strips 700 within slots 248 between labyrinth seal segments 246 prevent the natural frequency of pre-tuned turbine blades 200 from drifting to the operating speed range and/or provide vibration damping to the untuned blade mode. For instance, in experiments of disclosed embodiments, the vibration amplitude range was reduced by more than ten-fold and exhibited a faster decay rate, relative to an assembly without spring strips 700.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of turbine blade. Hence, although the present embodiments are, for convenience of explanation, depicted and described as being implemented in a particular turbine, it will be appreciated that it can be implemented in various other types of turbines, gas turbine engines, and machines with rotor blades, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A spring strip for vibration damping in a turbine blade, the spring strip comprising:

a flat portion;

a curved portion having a first end connected to the flat portion and a second end opposite the flat portion; and wherein the second end of the curved portion is malleable to bend into a tab in a direction away from the first end of the curved portion.

2. The spring strip of claim 1, wherein the flat portion comprises:

a first portion that extends in a first direction from the first end of the curved portion; and a second portion that extends in a second direction from the first end of the curved portion, wherein the second direction is opposite the first direction.

3. The spring strip of claim 2, wherein the second portion extends less in the second direction than the first portion extends in the first direction.

4. The spring strip of claim 1, wherein the flat portion consists of a single portion that extends in a single direction from the first end of the curved portion.

5. The spring strip of claim 1, wherein the flat portion comprises:

a first portion; and a second portion extending from the first portion and bent back towards the first portion.

6. A turbine blade comprising:

an airfoil; and a shroud having a leading edge and a trailing edge opposite the leading edge, wherein the shroud comprises a substrate connected to a first end of the airfoil, and a first labyrinth seal segment extending from the substrate along the leading edge, wherein the first labyrinth seal segment comprises a first slot configured to receive the spring strip of claim 1.

7. The turbine blade of claim 6, further comprising:

a platform attached to a second end of the airfoil that is opposite the first end; and a root extending from the platform on an opposite side of the platform than the second end of the airfoil, wherein the root is configured to connect to a turbine rotor disk.

8. The turbine blade of claim 7, wherein the shroud further comprises a second labyrinth seal segment extending from the substrate along the trailing edge and parallel to the first labyrinth seal, wherein the second labyrinth seal segment comprises a second slot configured to receive the spring strip.

9. The turbine blade of claim 8, wherein both the first labyrinth seal segment and the second labyrinth seal segment have a first end and a second end, wherein the first slot is on the first end of the first labyrinth seal segment, and wherein the second slot is on the second end of the second labyrinth seal segment.

10. The turbine blade of claim 9, wherein the first slot and the second slot are each a rectangular parallelepiped defined by three surfaces of the respective labyrinth seal segment and three open sides.

11. A turbine rotor assembly comprising the turbine rotor disk and a plurality of the turbine blades of claim 10, wherein the plurality of turbine blades are arranged circumferentially around the turbine rotor disk with the root of each of the plurality of turbine blades connected to the turbine rotor disk and the airfoil of each of the plurality of turbine blades extending radially between the turbine rotor disk and the respective shroud of each of the plurality of turbine blades, and wherein the shroud of each of the plurality of turbine blades abuts two adjacent shrouds of the plurality of turbine blades on opposite sides to form a contiguous annular shroud around the airfoils of the plurality of turbine blades and the turbine rotor disk.

12. The turbine rotor assembly of claim 11, wherein the first labyrinth seal segment of each of the plurality of turbine blades abuts two adjacent first labyrinth seal segments on opposite sides to form a first contiguous annular labyrinth seal, and wherein the second labyrinth seal segment of each of the plurality of turbine blades abuts two adjacent second labyrinth seal segments on opposite sides to form a second contiguous annular labyrinth seal.

13. The turbine rotor assembly of claim 12, further comprising a plurality of the spring strips, wherein each of the plurality of spring strips extends through one of the first slots or the second slots, and wherein each of the first slots and the second slots has one of the plurality of spring strips extending therethrough.

14. The turbine rotor assembly of claim 13, wherein each of the plurality of spring strips is positioned with the flat portion in contact with an outside surface of the respective contiguous annular labyrinth seal and the tab in contact with an inside surface of the respective contiguous annular labyrinth seal.

15. The turbine rotor assembly of claim 14, wherein the tab of each of the plurality of spring strips is longer than a width of the first slot and the second slot.

16. The turbine rotor assembly of claim 14, wherein the tab lies in a plane that is a preload distance from a plane in which the flat portion lies.

17. A turbine comprising a plurality of the turbine rotor assemblies of claim 14.

18. A gas turbine engine comprising:

a compressor;

a combustor downstream from the compressor; and the turbine of claim 17 downstream from the combustor.

19. A turbine rotor assembly comprising:

a turbine rotor disk; and a plurality of turbine blades arranged circumferentially around the turbine rotor disk and extending radially from the turbine rotor disk, wherein each of the plurality of turbine blades comprises an airfoil, and a shroud having a leading edge and a trailing edge opposite the leading edge, wherein the shroud comprises a substrate connected to a radially outward end of the airfoil, a first labyrinth seal segment extending from the substrate along the leading edge from a first end of the shroud to a second end of the shroud that is opposite the first end of the shroud, wherein the first labyrinth seal segment comprises a first slot at the first end of the shroud, and a second labyrinth seal segment extending from the substrate along the trailing edge from the first end of the shroud to the second end of the shroud and parallel to the first labyrinth seal segment, wherein the second labyrinth seal segment comprises a second slot at the second end of the shroud.

20. The turbine rotor assembly of claim 19, further comprising a plurality of spring strips, wherein each of the first slots and each of the second slots has one of the plurality of spring strips extending therethrough, and wherein each of the plurality of spring strips comprises:

a flat portion in contact with a first side of a labyrinth seal formed by the first or second labyrinth seal segments;

a curved portion extending through the respective slot, wherein each curved portion has a first end extending from the flat portion and a second end opposite the flat portion; and a tab extending from the second end of the curved portion in a direction away from the first end of the curved portion and in contact with a second side of the labyrinth seal that is opposite the first side of the labyrinth seal.

* * * * *